US010490929B2

(12) United States Patent
Walli et al.

(10) Patent No.: US 10,490,929 B2
(45) **Date of Patent: *Nov. 26, 2019**

(54) SUBSTITUTE FLANGE SLEEVE FOR ALTERNATIVE MOUNTING OF A CYLINDRICAL HEAVY DUTY DEUTSCH TYPE ON-BOARD DIAGNOSTIC RECEPTACLE

(71) Applicant: Geotab Inc., Oakville (CA)

(72) Inventors: Thomas Arthur Walli, Hamilton (CA); John Robert Ford Kyes, Burlington (CA)

(73) Assignee: Geotab Inc., Oakville (CA)

( * ) Notice: Subject to any disclaimer, the term of this patent is extended or adjusted under 35 U.S.C. 154(b) by 0 days.

This patent is subject to a terminal disclaimer.

(21) Appl. No.: 16/377,866

(22) Filed: Apr. 8, 2019

(65) Prior Publication Data

US 2019/0260154 A1 Aug. 22, 2019

Related U.S. Application Data

(63) Continuation of application No. 16/012,941, filed on Jun. 20, 2018, which is a continuation of application No. 14/757,177, filed on Dec. 1, 2015, now Pat. No. 10,033,130.

(51) Int. Cl.

| | |
|---|---|
| ***H01R 13/622*** | (2006.01) |
| ***H01R 13/516*** | (2006.01) |
| ***H01R 13/625*** | (2006.01) |
| *H01R 27/02* | (2006.01) |
| *H01B 7/00* | (2006.01) |

(52) U.S. Cl.
CPC ..... *H01R 13/516* (2013.01); *H01R 13/622* (2013.01); *H01R 13/625* (2013.01); *H01B 7/0045* (2013.01); *H01R 27/02* (2013.01); *H01R 2201/26* (2013.01)

(58) Field of Classification Search
CPC .. H01R 13/622; H01R 2201/26; H01R 27/02; H01R 7/0045
See application file for complete search history.

(56) References Cited

U.S. PATENT DOCUMENTS

| | | | | |
|---|---|---|---|---|
| 3,039,072 A | | 6/1962 | Robinson et al. | |
| 4,992,626 A | * | 2/1991 | Monroe | H01B 7/0045 156/51 |
| 5,971,799 A | * | 10/1999 | Swade | B60R 16/0207 439/502 |
| 6,863,552 B1 | | 3/2005 | Katwala et al. | |
| 7,225,065 B1 | | 5/2007 | Hunt et al. | |

(Continued)

OTHER PUBLICATIONS

U.S. Appl. No. 16/012,941, filed Jun. 20, 2018, Walli et al.

*Primary Examiner* — Tho D Ta
(74) *Attorney, Agent, or Firm* — Wolf, Greenfield & Sacks, P.C.

(57) ABSTRACT

An adapter is provided for use in association with a heavy duty vehicle, chassis-mountable, data bus signal wiring harness coupling. The coupling includes a receptacle having a generally circular cross-section and being adapted to be accommodated in longitudinal pass-through relation by a corresponding vehicle chassis mount including a mounting aperture for the coupling. The adapter may be slidably mounted on the receptacle for mounting to the vehicle chassis.

18 Claims, 5 Drawing Sheets

(56) References Cited

U.S. PATENT DOCUMENTS

| | | | | |
|---|---|---|---|---|
| 7,530,851 | B2 * | 5/2009 | Parnis ..... | H01R 13/68<br>439/503 |
| 10,033,130 | B2 | 7/2018 | Wali et al. | |
| 2005/0014410 | A1 | 1/2005 | Justice | |
| 2015/0255917 | A1 | 9/2015 | Chien et al. | |
| 2017/0155219 | A1 | 6/2017 | Wali et al. | |
| 2018/0316119 | A1 | 11/2018 | Walli et al. | |

* cited by examiner

SUBSTITUTE FLANGE SLEEVE FOR ALTERNATIVE MOUNTING OF A CYLINDRICAL HEAVY DUTY DEUTSCH TYPE ON-BOARD DIAGNOSTIC RECEPTACLE

RELATED APPLICATIONS

This Application is a Continuation of U.S. application Ser. No. 16/012,941, filed Jun. 20, 2018, titled "Substitute Flange Sleeve For Alternative Mounting Of A Cylindrical Heavy Duty Deutsch Type On-Board Diagnostic Receptacle", which is a Continuation of U.S. application Ser. No. 14/757,177, now U.S. Pat. No. 10,033,130, filed Dec. 1, 2015, titled "Substitute Flange Sleeve For Alternative Mounting Of A Cylindrical Heavy Duty Deutsch Type On-Board Diagnostic Receptacle", each of which is hereby incorporated by reference in its entirety.

FIELD

Aspects of the present disclosure relate to vehicle chassis mounting of so-called "Deutsch", standard cylindrical form-factor data bus wiring harness couplings using a substitute flange mounting sleeve compatible with corresponding original vehicle manufacturer's chassis mountings.

BACKGROUND

There are significant costs and logistical problems related to the provision of so-called heavy duty wiring harnesses that utilize Deutsch connectors for aftermarket installations of vehicular data bus accessing devices, including for example telematics devices for variously recording and/or transmitting vehicular data. Although the cylindrical form factor associated with such connectors is reasonably standard in the industry, the problems arise in providing for compatible flanges in mounting the connectors on differing manufacturers' vehicles, where the flange provisions for chassis OEM mountings of the in-cab diagnostic link connector can differ.

SUMMARY

According to one aspect, a data communication receptacle is provided. The receptacle includes a generally circular cross-section receptacle body adapted to pass-through a vehicle chassis mounting aperture in a vehicle chassis. The receptacle body has a length and includes a cam surface disposed along a portion of the length of the receptacle body at a distal end portion thereof. The cam surface is configured to rotatingly draw a compatible plug into axial engagement with the receptacle. An adapter is formed as a sleeve having a complementary inner circumferential surface to the receptacle body and is constructed and arranged to slidably fit about the receptacle body whereby the internal circumferential surface is configured to be in an abutting relation with the generally circular cross-section receptacle body when the adapter is installed on the receptacle body. The adapter includes an outer circumferential surface and an adapter flange radially outwardly extending from the outer circumference. The adapter further includes a distal end and an axial length that is less than the length of the receptacle body. The adapter is configured to be disposed along the length of the receptacle body at a position proximal of the cam surface such that the distal end portion and the cam surface of the receptacle body extends beyond the distal end of the adapter when the adapter is installed on the receptacle body. The adapter is constructed and arranged to engage with the vehicle chassis to fix the data communication receptacle to the vehicle chassis whereby the cam surface is positionable relative to the vehicle chassis mounting aperture to allow the cam surface to rotatingly draw the compatible plug into axial engagement with the receptacle. A key and slot coupling is constructed and arranged to secure an aligned fit between the adapter and the receptacle body to resist torsional movement of the adapter relative to the receptacle body when the adapter is installed on the receptacle body.

According to another aspect, a data communication receptacle is provided. The receptacle includes a generally circular cross-section receptacle body adapted to pass-through a vehicle chassis mounting aperture in a vehicle chassis. The receptacle body has a length and including a cam surface disposed along a portion of the length of the receptacle body at a distal end portion thereof. The cam surface is configured to rotatingly draw a compatible plug into axial engagement with the receptacle. An adapter is formed as a sleeve having a complementary inner circumferential surface to the receptacle body and constructed and arranged to slidably fit about the receptacle body whereby the internal circumferential surface is configured to be in an abutting relation with the generally circular cross-section receptacle body when the adapter is installed on the receptacle body. The adapter includes an outer circumferential surface and an adapter flange radially outwardly extending from the outer circumference. The adapter further includes a distal end and an axial length that is less than the length of the receptacle body. The adapter is configured to be disposed along the length of the receptacle body at a position proximal of the cam surface such that the distal end portion and the cam surface of the receptacle body extends beyond the distal end of the adapter when the adapter is installed on the receptacle body. The adapter is constructed and arranged to engage with the vehicle chassis to fix the data communication receptacle to the vehicle chassis whereby the cam surface is positionable relative to the vehicle chassis mounting aperture to allow the cam surface to rotatingly draw the compatible plug into axial engagement with the receptacle.

According to yet another aspect, a data communication receptacle is provided. The receptacle includes a generally circular cross-section receptacle body adapted to pass-through a vehicle chassis mounting aperture in a vehicle chassis. An adapter is formed as a sleeve having a complementary inner circumferential surface to the receptacle body and constructed and arranged to slidably fit about and secure to the receptacle body whereby the internal circumferential surface is in an abutting relation with the generally circular cross-section receptacle body. The adapter is constructed and arranged to engage with the vehicle chassis to fix the data communication receptacle to the vehicle chassis. The adapter includes an outer circumferential surface and an adapter flange radially outwardly extending from the outer circumference. A key and slot coupling is constructed and arranged to secure an aligned fit between the adapter and the receptacle body to resist torsional movement of the adapter relative to the receptacle body when the adapter is installed on the receptacle body.

The foregoing is a non-limiting summary of the disclosure. Other aspects, embodiments and/or features will become apparent from the following description.

Various embodiments of the present disclosure may provide certain advantages and may overcome certain drawbacks of prior devices. Embodiments of the disclosure may not share the same advantages, and those that do may not share them under all circumstances.

DETAILED DESCRIPTION

Figure 1:
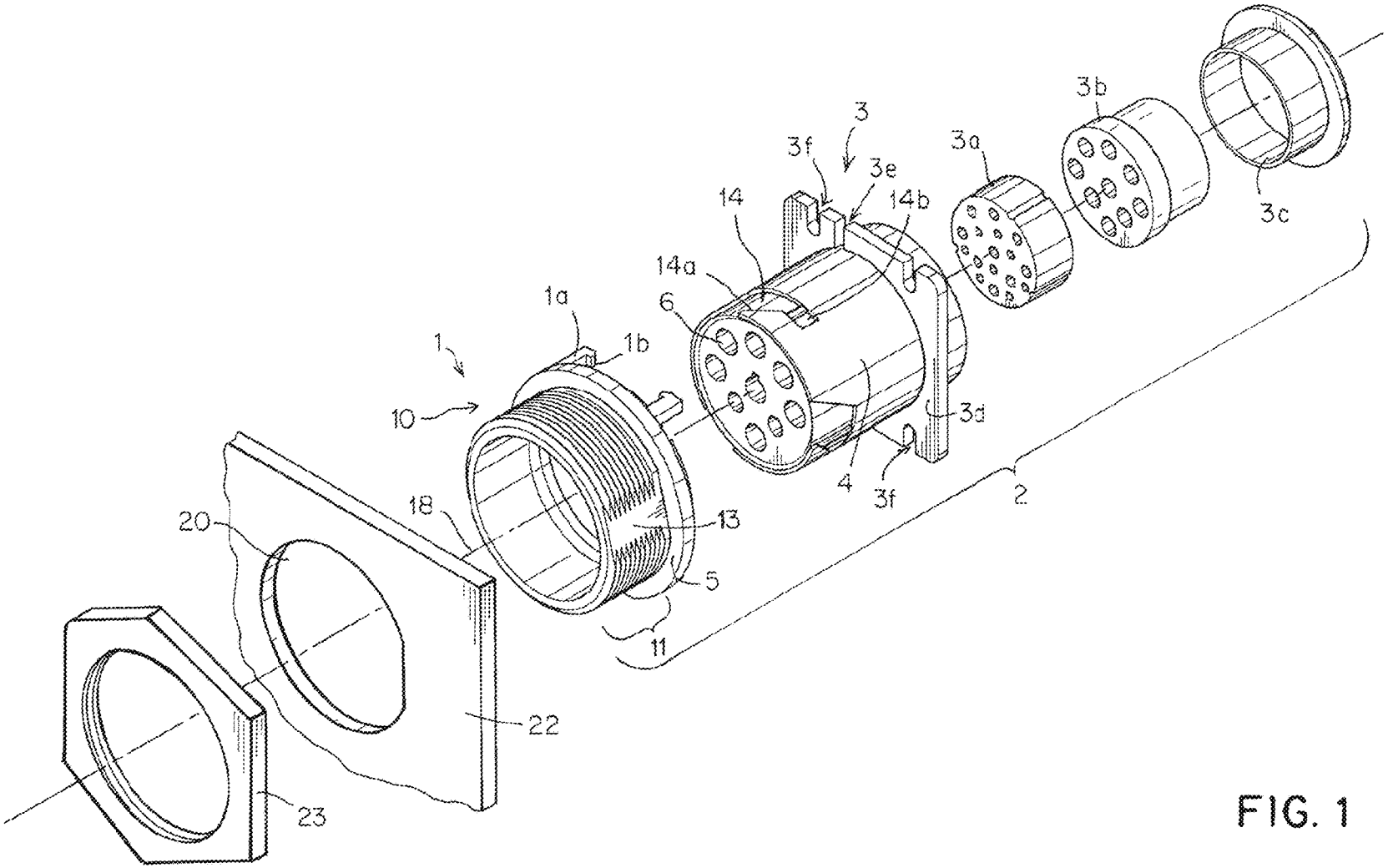
FIG. 1 depicts an exploded perspective view of a coupling according to one embodiment, including a substitute flange sleeve and a receptacle adapted to be mutually paired in an assembled coupling.

Referring now to the drawings in general, there are illustrated an elements and arrangements thereof useful in conjunction with a vehicle-mounting substitute flange sleeve 1 for use in association with a heavy duty vehicle, chassis-mountable, data bus signal wiring harness coupling 2 which further includes a receptacle 3.

Receptacle 3 has a generally circular cross-section cylindrical body 4 and is adapted to be accommodated in longitudinal pass-through relation within a corresponding vehicle chassis mounting aperture 20 in a vehicle chassis 22 for mounting the coupling 2 to the vehicle chassis. Receptacle 3 also has a plurality of conductor-receiving, longitudinally-extending bores indicated generally by reference numeral 6, which are adapted to be selectively populated by data bus signal wiring and associated contact terminals with contact terminal fixture 3*a*, seal 3*b* and back collar 3*c*. The population of terminals variously corresponds in numbering and arrangement to a corresponding heavy duty vehicle's data bus data link connector. Note that receptacle 3 further includes openings (e.g. slots) 3*f*, in flange 3*d*—which in installations not requiring sleeve 1, correspond to vehicle chassis mounting holes and facilitate jointing of the receptacle 3 to the vehicle chassis (vehicle chassis mounting holes are not shown in FIG. 1 because they are lacking in this example of the vehicle chassis).

Sleeve 1 includes a center longitudinal axis 18. Sleeve 1 is adapted to be slidably mounted into cooperative engagement in conjoined, axially and radially fixed relation on receptacle 3 (see in particular, the assembly shown in FIG. 4) with the sleeve's flange 5 engagable in flange-matching chassis-secured relation adjacent the vehicle chassis mounting aperture 20 with the receptacle 3 supported thereby in pass-thru relation with the aperture 20 when the coupling 2 with sleeve 1 is mounted to vehicle chassis 22 as can be readily appreciated in the exploded perspective view of FIG. 1.

Figure 4:
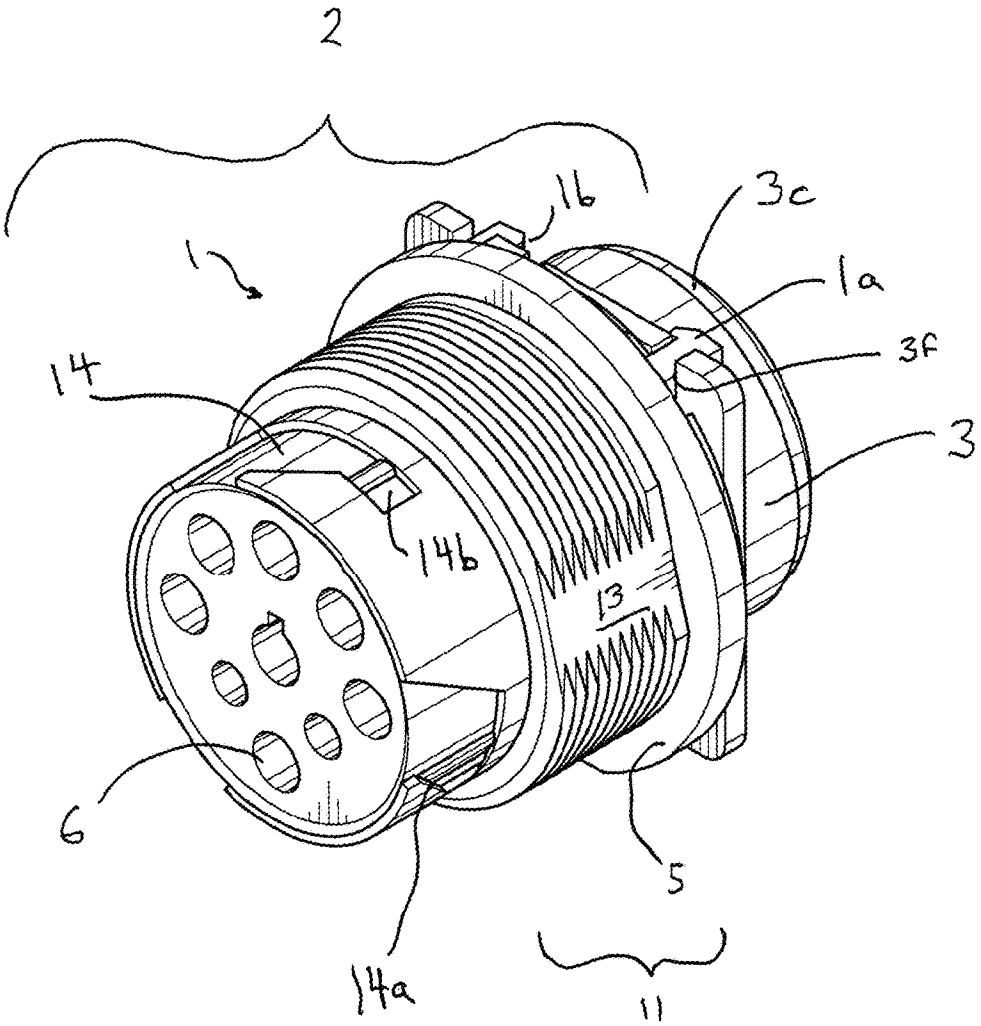
FIG. 4 depicts a perspective view of a sleeve/receptacle assembly according to an embodiment.

Diverse arrangements for mutually securing the sleeve to the receptacle are contemplated, and might include welding, chemical bonding, screws, or other such like. However, particular advantages accrue when the securing means comprises one or more pins 1*a* axially extending from sleeve 1 which are adapted to engage in conjoined axially and radially fixed relation with receptacle flange 3*d*. Pins 1*a* are advantageously arranged to engage in aligned locking registration through corresponding receptacle slots 3*f*, with tabs 1*b* as shown in FIGS. 1 and 4, extending in a non-axial and a non-radial direction with respect to the center longitudinal axis 18 of sleeve 1 and engaged in axial-withdrawal resisting relation against the rear side of flange 3*d*. This provision or cooperating mechanical members co-joins the sleeve 1 with receptacle 3 in a mutually fixed mechanical relation.

In the embodiment according to FIG. 1, sleeve 1 comprises flange 5 as a radially outward extension from the outer circumference of sleeve 1. Sleeve 1 also includes threads 10 arranged over at least a portion 11 of the outer circumferential surface of sleeve 1. Threads 10 are adapted for axially engaging a jam nut 23 in threaded relation thereon and co-operable therewith to secure the vehicle chassis 22 between the flange 5 and that nut 23.

Figure 2:
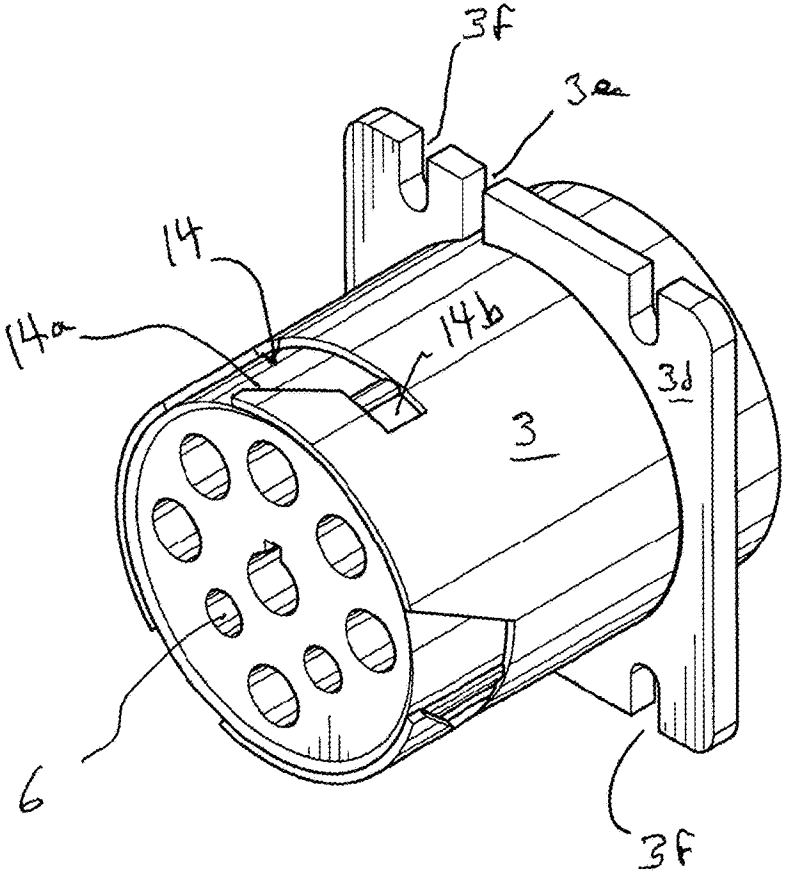
FIG. 2 depicts a perspective view showing a Deutsch type receptacle.
Figure 3:
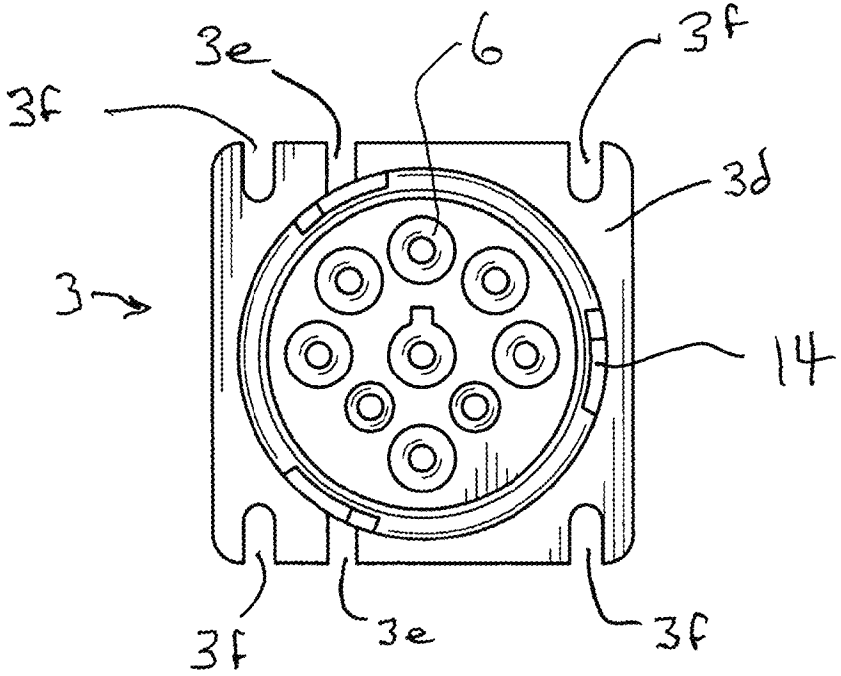
FIG. 3 depicts an elevated side view of the assembled coupling depicted in FIG. 2.

FIGS. 2, 3 and the present disclosure in general, relate to alternative flange mounting for cylindrical receptacles, notionally referred to as Deutsch receptacles associated with their conventional use in heavy duty vehicles data communication links. These are often associated with various standards. SAE 31587 for example is a diagnostic protocol standard developed by the Society of Automotive Engineers (SAE) for heavy-duty and most medium-duty vehicles built after 1985. Up to 1995, individual OEMs used their own connectors. From 1996 to 2001, the 6-pin Deutsch was standard. Beginning in 2001, most OEMs converted to the 9-pin Deutsch. Some OEMs still use the 6-pin Deutsch. SAE 31708 is an SAE physical specification developed especially for heavy duty vehicles (trucks and buses). The protocol promoted a standard for serial communication between modules with microcontrollers. 31708 describes the physical and data link layer. Almost always used in conjunction with the application layer protocol SAE 31587. SAE 31939 In the early 90's, the SAE Truck and Bus Control and Communications Sub-committee started the development of a CAN-based application profile for in-vehicle communication in trucks. In 1998 the SAE published the 31939 set of specifications. A 31939 network connects electronic control units (ECU) within a truck and trailer system. The 31939 specification—with its engine, transmission, and brake message definitions—is dedicated to diesel engine applications. 31939 is intended to supplant 31587/31708 networks. SAE 31939 has been adopted widely by diesel engine manufacturers. One driving force behind this is the increasing adoption of the engine Electronic Control Unit (ECU), which provides one method of controlling exhaust gas emissions within US and European standards. Consequently, SAE 31939 can now be found in a range of diesel-powered applications: vehicles (on- and off-road), marine propulsion, power generation and industrial pumping. In this regard, examples of applicable receptacles would be those useful in 9 pin Deutsch 31939 type 1 or type 2 connector receptacles; 9 pin Deutsch PACCAR connector receptacles; 9 Pin Deutsch CAT industrial connector receptacles; 9 pin Deutsch SAE Standard Heavy Duty truck connector receptacles, as well as 6 pin Deutsch 31708/31587 heavy duty truck connector receptacles used in older truck models.

In particular, aspects relate to receptacles having integral flanges (see for example ref. numeral 3*d* with slots 3*f*), adapted for vehicle chassis mounting on receptacle flange compatible vehicles—but for which a sleeve arrangement is provided to facilitate alternative coupling mounting on such vehicle chassis through a flanged sleeve of a sleeve/receptacle combination for use on vehicles that are not otherwise receptacle flange compatible.

Referring still to FIGS. 2 and 3, there is shown perspective and elevated end plan views of receptacle 3. Note in particular the "twist-lock" features 14 (also referred to as "receptacle channel features" 14 or simply "channel features" 14) of receptacles 3 in this embodiment. These are known features associated with Deutsch connectors commonly used for interfacing with vehicular diagnostic scan tools which have cooperative plugs adapted to engage with the receptacles that include a twist-lock collar and associated channel followers that bear against cam faces of channel feature 14 when the collar is twisted to ensure proper axial seating of the plug into the receptacle. The turning of the collar, in known manner, results in the application of torque to the receptacle. In accordance with one embodiment, receptacle 3 is adapted in known manner with channel features 14, including cam faces 14*a* and channel feature stops 14*b*. Corresponding, and also known, compatible plugs are axially seated into the receptacle by way of a rotating twist-lock collar (not shown) having channel cam followers (also not shown) within receptacle channel features 14. As a result of such rotation, the channel followers can act against a cam surface 14*a* of channel feature 14 of receptacles 3 to rotatingly leverage (draw) the plug into axial connected axial engagement with receptacle 3 with the channel cam followers ultimately bearing against the channel stop 14*b*. Torque exerted on the receptacle 3 in this way, must be resisted to prevent relative rotation between receptacle 3 and sleeves 1.

Referring now to FIG. 4, there is illustrated an elevated side view assembly of the embodiment shown in FIG. 2, in which sleeve 1 with flange 5 is shown positioned on receptacle 3. Coupling 2 includes sleeve 1 with flange 5 surrounding receptacle 3. Sleeve 1 may also include a flat 13. Flat 13 provides optional means for securing the sleeve in non-rotating relation relative to the vehicle chassis 22 having a correspondingly shaped aperture 20 and may also facilitate clearance for insertion of the sleeve into the vehicle chassis mounting aperture 20.

Sleeve 1 is shown in mounted relation with flange 5 on receptacle flange 3*d*, with a view of bores 6. Note in particular see FIG. 1 the representation of slotted key openings 3*e* in receptacle flange 3*d*. Slotted key openings 3*e* are advantageous in securing the aligned fit between sleeve 1 and receptacle 3 through a corresponding key (not shown) on flange 5, which is adapted to mechanically engage with slotted key opening 3*e* and amongst other things, resist torsional movement of sleeve 1 relative to receptacle 3 during connection/disconnection of the scan tool or other peripheral device.

In addition, in accordance with the illustrated arrangement of the elements as shown in FIG. 4, the torque mentioned above in relation to the seating of the compatible plug (by way of a rotating collar acting on a cam surface of said receptacle to rotating draw said plug into axial connected axial engagement with said receptacle, and wherein torque exerted by rotation of said collar during axial engagement thereof into said receptacle), urges the pins 1*a* against edges of the slots 3*f* in said relation therewith to generally prevent relative rotation between receptacle 3 and sleeve 1.

Figure 5:
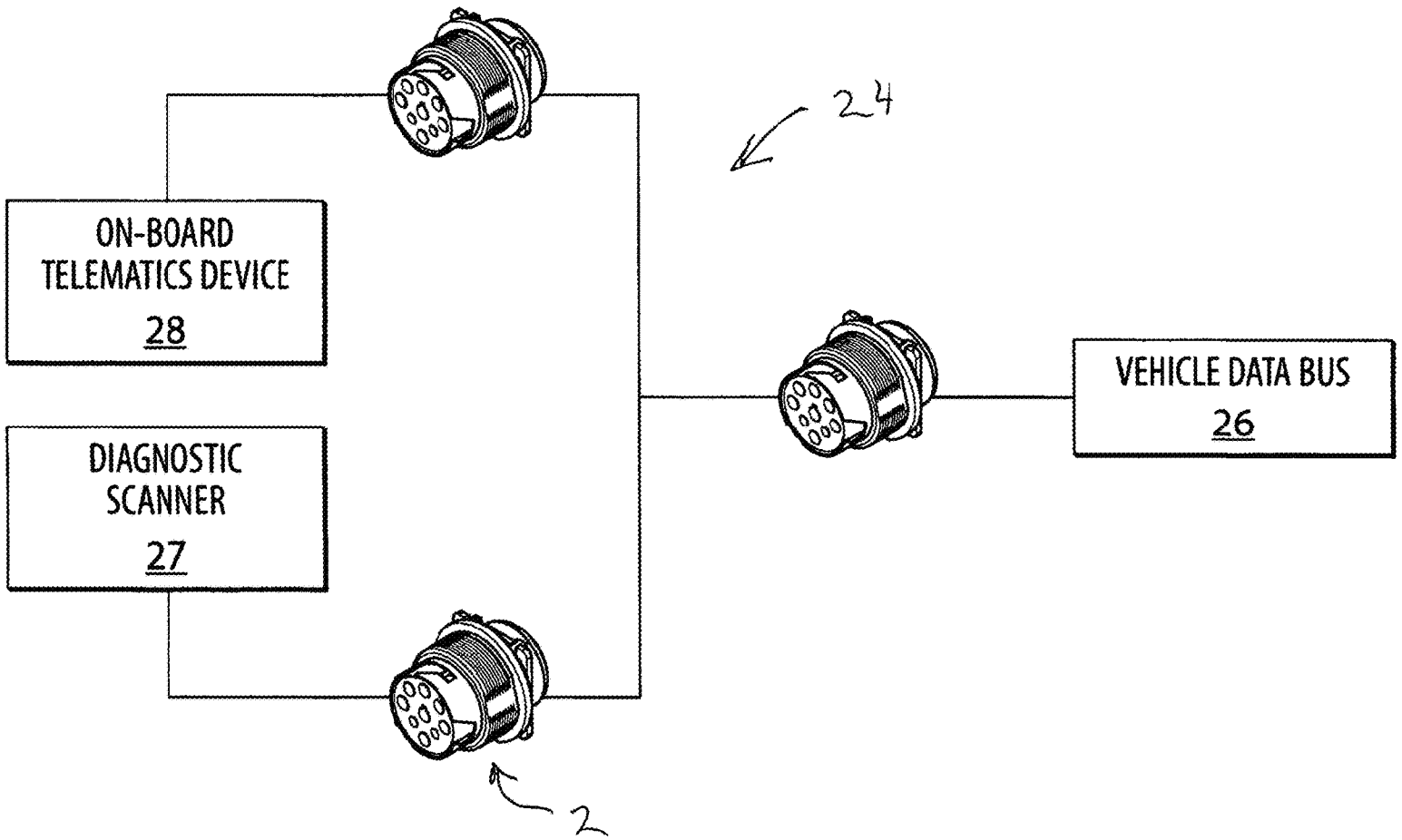
FIG. 5 depicts a "T" wiring harness including a coupling in accordance with one embodiment.

Referring now to FIG. 5, there is illustrated a coupling according to one embodiment in combination with a T or Y type wiring harness 24, connected at one end to a vehicle data link connector (DLC) not shown, that is associated with a vehicle's data bus 26. Coupling 2 is connected to a plug and associated diagnostic tool 27. The other branch of the wiring harness 24, is connected to an on-board telematics device 28 (often an after-market installation which is facilitated though the use of the multi-branched wiring harness 24).

What is claimed is:

1. A data communication receptacle, comprising:

a generally circular cross-section receptacle body adapted to pass-through a vehicle chassis mounting aperture in a vehicle chassis, the receptacle body having a length and including a cam surface disposed along a portion of the length of the receptacle body at a distal end portion thereof, the cam surface configured to rotatingly draw a compatible plug into axial engagement with the receptacle;

an adapter formed as a sleeve having a complementary inner circumferential surface to the receptacle body and constructed and arranged to slidably fit about the receptacle body whereby the internal circumferential surface is configured to be in an abutting relation with the receptacle body when the adapter is installed on the receptacle body, the adapter including an outer circumferential surface and an adapter flange radially outwardly extending from the outer circumference, the adapter further including a distal end and an axial length that is less than the length of the receptacle body, the adapter being configured to be disposed along the length of the receptacle body at a position proximal of the cam surface such that the distal end portion and the cam surface of the receptacle body extends beyond the distal end of the adapter when the adapter is installed on the receptacle body, the adapter being constructed and arranged to engage with the vehicle chassis to fix the data communication receptacle to the vehicle chassis whereby the cam surface is positionable relative to the vehicle chassis mounting aperture to allow the cam surface to rotatingly draw the compatible plug into axial engagement with the receptacle; and, a key and slot coupling constructed and arranged to secure an aligned fit between the adapter and the receptacle body to resist torsional movement of the adapter relative to the receptacle body when the adapter is installed on the receptacle body.

2. The data communication receptacle according to claim 1, wherein the adapter includes an outer circumferential surface and an adapter flange radially outwardly extending from the outer circumference.

3. The data communication receptacle according to claim 1, wherein the outer circumferential surface of the adapter includes a threaded section.

4. The data communication receptacle according to claim 3, further comprising a lock nut engageable with the threaded section.

5. The data communication receptacle according to claim 1, further comprising a wiring harness for coupling to a vehicle data bus, the wiring harness comprising a first branch, a second branch and a third branch, a first connector is attached to the first branch, a second connector is attached to the second branch and a third connector is attached to the third branch, the third connector comprising the data communication receptacle.

6. The data communication receptacle according to claim 5, wherein the first connector is configured to connect to a vehicle data bus, the second connector is configured to connect to a telematics device, and the data communication receptacle is configured to connect to a diagnostic scanner.

7. A data communication receptacle, comprising:

a generally circular cross-section receptacle body adapted to pass-through a vehicle chassis mounting aperture in a vehicle chassis, the receptacle body having a length and including a cam surface disposed along a portion of the length of the receptacle body at a distal end portion thereof, the cam surface configured to rotatingly draw a compatible plug into axial engagement with the receptacle; and, an adapter formed as a sleeve having a complementary inner circumferential surface to the receptacle body and constructed and arranged to slidably fit about the receptacle body whereby the internal circumferential surface is configured to be in an abutting relation with the receptacle body when the adapter is installed on the receptacle body, the adapter including an outer circumferential surface and an adapter flange radially outwardly extending from the outer circumference, the adapter further including a distal end and an axial length that is less than the length of the receptacle body, the adapter being configured to be disposed along the length of the receptacle body at a position proximal of the cam surface such that the distal end portion and the cam surface of the receptacle body extends beyond the distal end of the adapter when the adapter is installed on the receptacle body, the adapter being constructed and arranged to engage with the vehicle chassis to fix the data communication receptacle to the vehicle chassis whereby the cam surface is positionable relative to the vehicle chassis mounting aperture to allow the cam surface to rotatingly draw the compatible plug into axial engagement with the receptacle.

8. The data communication receptacle according to claim 7, wherein the adapter includes an outer circumferential surface and an adapter flange radially outwardly extending from the outer circumference.

9. The data communication receptacle according to claim 7, wherein the adapter includes an outer circumferential surface having a threaded section.

10. The data communication receptacle according to claim 9, further comprising a lock nut engageable with the threaded section.

11. The data communication receptacle according to claim 7, further comprising a wiring harness for coupling to a vehicle data bus, the wiring harness comprising a first branch, a second branch and a third branch, a first connector is attached to the first branch, a second connector is attached to the second branch and a third connector is attached to the third branch, the third connector comprising the data communication receptacle.

12. The data communication receptacle according to claim 11, wherein the first connector is configured to connect to a vehicle data bus, the second connector is configured to connect to a telematics device, and the data communication receptacle is configured to connect to a diagnostic scanner.

13. A data communication receptacle, comprising:

a receptacle body having a generally circular cross-section, the receptacle body adapted to pass-through a vehicle chassis mounting aperture in a vehicle chassis, the receptacle body having a length and including a distal end; and, an adapter formed as a sleeve having a complementary inner circumferential surface to the receptacle body and constructed and arranged to slidably fit about and secure to the receptacle body whereby the internal circumferential surface is in an abutting relation with the receptacle body, the adapter being constructed and arranged to engage with the vehicle chassis to fix the data communication receptacle to the vehicle chassis, the adapter including an outer circumferential surface and an adapter flange radially outwardly extending from the outer circumferential surface, the adapter further including a distal end and an axial length that is less than the length of the receptacle body, the adapter being configured to be disposed along the length of the receptacle body at a position proximal of the distal end of the receptacle body such that the distal end of the receptacle body extends beyond the distal end of the adapter when the adapter is installed on the receptacle body; and, a key and slot coupling constructed and arranged to secure an aligned fit between the adapter and the receptacle body to resist torsional movement of the adapter relative to the receptacle body when the adapter is installed on the receptacle body.

14. The data communication receptacle according to claim 13, wherein the receptacle body includes a cam surface configured to rotatingly draw a plug into axial engagement with the receptacle.

15. The data communication receptacle according to claim 13, wherein the adapter includes an outer circumferential surface having a threaded section.

16. The data communication receptacle according to claim 15, further comprising a lock nut engageable with the threaded section.

17. The data communication receptacle according to claim 13, further comprising a wiring harness for coupling to a vehicle data bus, the wiring harness comprising a first branch, a second branch and a third branch, a first connector is attached to the first branch, a second connector is attached to the second branch and a third connector is attached to the third branch, the third connector comprising the data communication receptacle.

18. The data communication receptacle according to claim 17, wherein the first connector is configured to connect to a vehicle data bus, the second connector is configured to connect to a telematics device, and the data communication receptacle is configured to connect to a diagnostic scanner.

* * * * *